US005443376A

United States Patent [19]

Choi

[11] Patent Number: 5,443,376

[45] Date of Patent: Aug. 22, 1995

[54] LUBRICATING DEVICE FOR HORIZONTAL TYPE ROTARY COMPRESSOR

[75] Inventor: Song Choi, Kyungki-Do, Rep. of Korea

[73] Assignee: Goldstar Co., Ltd., Rep. of Korea

[21] Appl. No.: 168,373

[22] Filed: Dec. 15, 1993

[30] Foreign Application Priority Data

Dec. 17, 1992 [KR] Rep. of Korea ..... 25800/1992
Dec. 29, 1992 [KR] Rep. of Korea ..... 27380/1992

[51] Int. Cl.[6] ..... F04C 18/00

[52] U.S. Cl. ..... 418/63; 418/88; 418/94; 418/248; 417/204

[58] Field of Search ..... 418/63, 88, 91, 94, 418/248; 417/204, 902

[56] References Cited

U.S. PATENT DOCUMENTS 4,561,829 12/1985 Iwata et al. ..... 418/63
5,015,164 5/1991 Kudou et al. ..... 418/63
5,098,266 3/1992 Takimoto et al. ..... 418/63

FOREIGN PATENT DOCUMENTS 0873297 4/1953 Germany ..... 418/63
0029795 2/1984 Japan ..... 418/248

*Primary Examiner*—Richard A. Bertsch
*Assistant Examiner*—Charles G. Freay
*Attorney, Agent, or Firm*—Ostrolenk, Faber, Gerb & Soffen

[57] ABSTRACT

A lubricating device for a horizontal type rotary compressor having an oil pumping chamber formed under the vane in the compression cylinder. The oil pumping chamber is provided in the compression cylinder under the vane and has an oil inlet port and an oil outlet port provided on at least one of its side walls. An oil piston is received in the pumping chamber such that it elastically vertically reciprocates in the pumping chamber in accordance with vertical reciprocation of the vane. The piston is biased upwards at the outside of the pumping chamber by a steel wire spring which is connected at one end thereof to the oil piston and at the other end thereof to one of the compression cylinder, the main bearing and the sub bearing. An oil feed pipe is connected between the oil outlet port of the pumping chamber and an oil conduit of the eccentric rotating shaft. A hydraulic diode, of which the upper diameter is not smaller than the lower diameter, may be axially formed in the oil piston. In this case, the oil piston is biased upwards by a compression coil spring instead of the steel wire spring.

12 Claims, 9 Drawing Sheets

LUBRICATING DEVICE FOR HORIZONTAL TYPE ROTARY COMPRESSOR

BACKGROUND OF THE INVENTION

1. Field of the Invention

The present invention relates in general to a lubrication for a horizontal type rotary compressor and, more particularly, to a lubricating device for the horizontal type rotary compressor.

2. Description of the Prior Art

With reference to FIGS. 1A and 1B, there is shown a construction of a conventional lubricating device for a horizontal type rotary compressor. The compressor has an eccentric rotating shaft 4 which is axially positioned in a shell 1 constituting a horizontal compressor casing. The eccentric shaft 4 is received in a cylindrical cavity of a compression cylinder 2, defining a compression chamber C therein, and provided with a roller 3 thereabout. An outer surface of this roller 3 comes into contact with an inner surface of the compression cylinder 2. The cylinder 2 is coupled at its both sides to a main bearing 5 and a sub bearing 6, respectively, which support the shaft 4 at opposed sides of the cylinder 2 and define the compression chamber C in cooperation with the inner surface of the cylinder 2. The compressor is provided with the lubricating device for lubrication of its friction parts. The lubricating device comprises a vane slot 2*a* which is provided in a lower section of the cylinder 2 such that it communicates with the compression chamber C of the cylinder 2. This vane slot 2*a* movably receives a spring-biased vane 7 which is biased upwards by a compression coil spring 8 provided under the vane 7. The distal end of the vane 7 comes into close contact with the outer surface of the roller 3, so that when the roller 3 of the shaft 4 is eccentrically rotated in the cavity of the cylinder 2 in accordance with the rotation of the shaft 4, the spring-biased vane 7 elastically advances and retracts. Otherwise stated, this vane 7 vertically reciprocates in the vane slot 2*a*. An oil pumping chamber 9 is provided in the cylinder 2 under the vane slot 2*a*. The pumping chamber 9 is defined by the lower end of the reciprocating vane 7, and the main and sub bearings 5 and 6 coupled to both sides of the compression cylinder 2.

The oil pumping chamber 9 is provided with an oil inlet hydraulic diode 10 formed in the sub bearing 6 and with an oil outlet hydraulic diode 11 formed in the main bearing 5. Owing to the vertical reciprocation of the vane 7, the lubrication oil "o" charged in the lower section of the shell 1 flows in the oil pumping chamber 9 through the oil inlet diode 10 and, thereafter, is delivered to an oil conduit 13 of the rotating shaft 4 through the oil outlet diode 11 in order to be supplied to the friction parts of the compressor. The communication of the oil outlet diode 11 with the oil conduit 13 of the rotating shaft 4 is achieved by an oil feed pipe 12 connected therebetween.

The oil conduit 13 of the rotating shaft 4 is in turn provided with a plurality of lubricating slots 13*a* which vertically extend from the conduit 13 and through which the oil conduit 13 communicates with friction parts of the compressor.

As shown in FIG. 1A, each of the oil inlet and outlet diodes 10 and 11 has a nozzle shape such that the sectional areas at both ends thereof are different from each other. That is, the nozzle shape of the inlet diode 10 is concentrated toward the pumping chamber 9 while the nozzle shape of the outlet diode 10 is concentrated toward the outside of the pumping chamber 9. Due to the shapes of the diodes 10 and 11, the flow resistance of the diodes 10 and 11 is very small when the lubrication oil flows leftwards as shown at the arrows of FIG. 1A. However, the flow resistance of the diodes 10 and 11 is remarkably increased when the lubrication oil flows rightwards, so that very small amount of oil flows through the diodes 10 and 11 even though the pressure difference between the inside and the outside of the pumping chamber 9 in the rightward flowing of the oil remains the same as that of the leftward flowing of the oil. In this regard, the diodes 10 and 11 result in a problem that when it is require to flow the lubrication oil in opposed directions, the desired smooth flow of the lubrication oil through them is achieved only in one direction, that is, the leftward direction.

In operation of the above lubricating device, the vertical elastic reciprocation of the vane 7 caused by eccentric rotation of the shaft 4 causes the lubrication oil "o" in the shell 1 to flow through the inlet diode 10, the pumping chamber 9, the outlet diode 11 and the oil feed pipe 12, thus to be introduced to the oil conduit 13 of the shaft 4. At this time, the aforementioned flowing of the lubrication oil is achieved by change of the inner volume of the pumping chamber 9 as well as by an oil pressure difference between the inside of the shell 1, the pumping chamber 9 and the oil feed pipe 12 generated by the vertical reciprocation of the vane 7.

For example, when the vane 7 moves upwards, the volume occupied by the vane 7 in the pumping chamber 9 is reduced and this causes generation of negative pressure in the pumping chamber 9. The lubrication oil in the shell 1 is thus sucked into the pumping chamber 9 through the oil inlet diode 10. At this time, the lubrication oil intending to reversely flow from the feed pipe 12 to the pumping chamber 9 is limited in its amount to be very small since the oil outlet diode 11 restricts the reverse flow of the oil due to its shape. Thereafter, the vane 7 moves downwards as a result of the rotation of the shaft 4, so that the inner volume of the pumping chamber 9 is reduced and, as a result, the oil in the chamber 9 is compressed. The lubrication oil under pressure is thus supplied to the rotating shaft 4 through the oil outlet diode 11 and the oil feed pipe 12.

During the oil supply from the pumping chamber 9 to the shaft 4, the lubrication oil intending to reversely flow from the pumping chamber 9 to the inside of the shell 1 is limited in its amount to be very small since the oil inlet diode 10 restricts the reverse flow of the oil due to its shape. A predetermined amount of lubrication oil, that is, the difference between the amount of the lubrication oil flowing out through the oil outlet diode 11 and the amount of the lubrication oil flowing out through the oil inlet diode 10, is supplied to the oil conduit 13 of the shaft 4 through the oil feed pipe 12 and in turn to the friction parts of the compressor through the lubricating slots 13*a*.

However, the conventional lubricating device for the horizontal type rotary compressor should have the main and sub bearing 5 and 6 which are relatively larger in their sizes since they support the rotating shaft 4 at opposed sides of the compression cylinder 2 and also cover the opposed sides of the vane 7 in order to form the side walls of the pumping chamber 9. Due to the larger size of the bearings 5 and 6, the conventional lubricating device introduces a problem that it increases the size and the cost of the compressor.

The lubricating device should have the compression coil spring 8 in the oil pumping chamber 9 for biasing the vane 7 upwards. Hence, when the lubricating device is adapted to a compressor having a longer distance between upper and bottom dead points of the vane 7, that is, having a larger eccentricity of the rotating shaft 4, the compression coil spring 8 is inevitably limited in its minimum height during its compression. Furthermore, when the lubrication oil in the pumping chamber 9 is compressed, the compressed coil spring 8 is such reduced in the gaps between its coils that there is generated a flow resistance in the pumping chamber 9 by the presence of the compressed coil spring 8, thus to prevent a desired smooth flowing of the lubrication oil in the chamber 9.

In addition, the lubricating device generates bubbles in the lubrication oil in the shell 1 during its initial operation and introduces the bubbles together with the lubrication oil to the oil conduit 13 of the rotating shaft 4, thus to result in a bad lubrication.

SUMMARY OF THE INVENTION

It is, therefore, an object of the present invention to provide a lubricating device for a horizontal type rotary compressor in which the aforementioned problems can be overcome and of which an oil pumping chamber is not defined by the main and sub bearings but formed under the vane in the compression cylinder, thus to reduce the volume and weight of the bearings and to achieve the recent trend of compactness and lightness of the compressor.

It is another object of the present invention to provide a lubricating device for a horizontal type rotary compressor which is provided with an oil piston received in the oil pumping chamber and cooperating with the vertical reciprocation of the vane, and uses a steel wire spring as a biasing member for biasing the oil piston upwards, thus to allow the biasing member to be provided on the outside of the oil pumping chamber and to easily change the designing conditions of the compressor, and to achieve a desired smooth oil supply by removing the conventional compression coil spring, causing the flow resistance, from the pumping chamber.

It is a further object of the present invention to provide a lubricating device for a horizontal type rotary compressor which is provided with an axial gas exhaust hole at the center of the oil piston, thus to remove the gas bubbles from the lubrication oil and to provide a good lubrication oil, having no bubbles, for the friction parts of the compressor and to improve the reliability of the compressor.

It is yet another object of the present invention to provide a lubricating device for a horizontal type rotary compressor of which the oil piston includes a movable hydraulic diode, thus to simplify the construction of the compressor and to provide an effective oil supply.

In order to accomplish the above object, a lubricating device for a horizontal type rotary compressor in accordance with an embodiment of the present invention comprises: a vane movably received in a vane slot provided in a lower section of a compression cylinder of the compressor, a top of the vane contacting with an outer surface of a roller of an eccentric rotating shaft such that it vertically reciprocates in accordance with rotation of the shaft; a cylindrical oil pumping chamber provided in the compression cylinder under the vane, the chamber having an oil inlet port and an oil outlet port provided on at least one of its side walls for sucking and delivering lubrication oil, respectively, the ports being spaced out at a predetermined interval; an oil piston received in the pumping chamber such that it elastically vertically reciprocates in the pumping chamber in accordance with vertical reciprocation of the vane; a steel wire spring connected at one end thereof to the oil piston and at the other end thereof to one of the compression cylinder, the main bearing and the sub bearing for biasing the oil piston upwards at the outside of the pumping chamber; and an oil feed pipe connected between the oil outlet port of the pumping chamber and an oil conduit of the eccentric rotating shaft.

The oil piston includes an axial gas exhaust hole for exhausting gases included in the lubrication oil to the outside of the chamber and for allowing the lubrication oil to flow therethrough. The piston also includes a wire spring support hole extending perpendicular to the gas exhaust hole. The gas exhaust hole is a straight hole, a stepped hole or a tapered hole.

In accordance with another embodiment of this invention, a hydraulic diode, of which the upper diameter is not smaller than the lower diameter, is axially formed in the oil piston. The oil piston also includes a cylindrical or annular support recess on its lower surface for supporting the upper end of a compression coil spring biasing the oil piston toward the vane.

BRIEF DESCRIPTION OF THE DRAWINGS

The above and other objects, features and other advantages of the present invention will be more clearly understood from the following detailed description taken in conjunction with the accompanying drawings, in which:

FIGS. 11A and 11B are sectional views showing the oil pumping operation of the lubricating device of FIG. 2A, respectively, in which:

FIG. 11A shows an oil sucking operation; and

FIG. 11B shows an oil compressing and supplying operation.

DESCRIPTION OF THE PREFERRED EMBODIMENTS

Figure 2A:
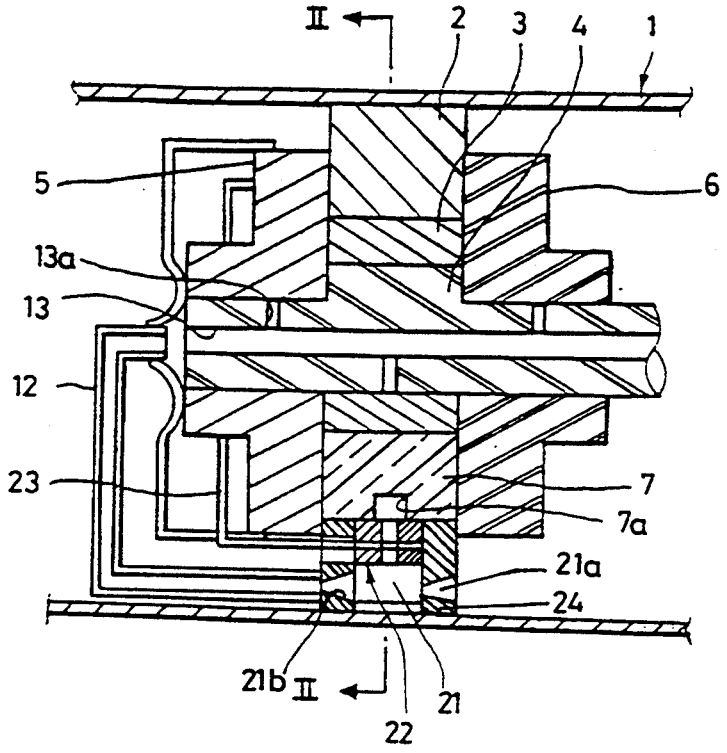
FIG. 2A is a partial sectional view showing a construction of a lubricating device for a horizontal type rotary compressor in accordance with an embodiment of the present invention.
Figure 2B:
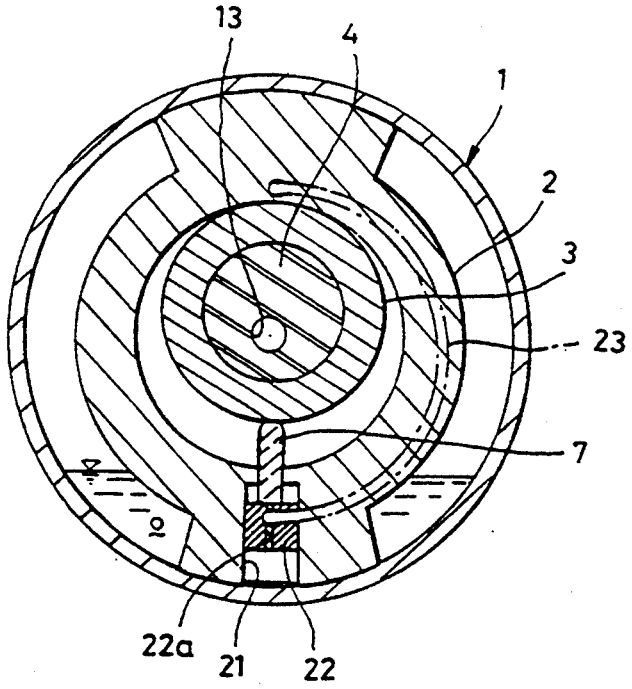
FIG. 2B is a sectional view of the lubricating device taken along the section line II—II of FIG. 2A.

FIG. 2A is a partial sectional view showing a construction of a lubricating device for a horizontal type rotary compressor in accordance with a primary embodiment of the present invention and FIG. 2B is a sectional view of the lubricating device taken along the section line II—II of FIG. 2A. As shown in this drawings, the lubricating device of this invention includes an oil pumping chamber 21 comprising a cylindrical cavity formed under a vane 7 in a compression cylinder 2 encased by a shell 1 constituting a horizontal compressor casing. The oil pumping chamber 21 is provided with a pair of oil ports, that is, an oil inlet port 21*a* and an oil outlet port 21*b* which are formed on a side wall or on opposed side walls of the cylindrical cavity of the chamber 21.

An oil piston 22 is slidably received in the oil pumping chamber 21 such that it vertically reciprocates in the chamber 21 in accordance with the vertical reciprocation of the vane 7 and pumps the lubrication oil. The oil piston 22 is biased upwards at the outside of the chamber 21 by a steel wire spring 23 which is connected at one end thereof to the oil piston 22 and at the other end thereof to the compression cylinder 2 or to one of main and sub bearings 5 and 6. The oil outlet port 21*b* of the oil pumping chamber 21 communicates with an oil conduit 13 of the rotating shaft 4 by an oil feed pipe 12.

If briefly described, the oil pumping chamber 21 is provided under the vane 7 in the compression cylinder 2 and includes the oil outlet port 21*b* for delivering the lubrication oil under pressure from the chamber 21 to the oil conduit 13 of the shaft 4. Here, the oil outlet port 21*b* of the chamber 21 communicates with the oil conduit 13 of the shaft 4 by the oil feed pipe 12, thus to introduce the oil under pressure to the oil conduit 13.

Figure 3A:
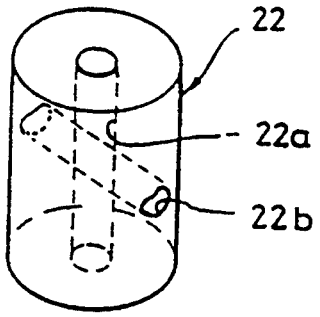
FIG. 3A is an enlarged perspective view of an oil piston used in the lubricating device of FIG. 2A.

In addition, the oil piston 22 is received in the oil pumping chamber 21 such that it is biased upwards by the steel wire spring 23 in order to come into close contact with the lower end of the vane 7 and to vertically reciprocate in accordance with reciprocation of the vane 7. The oil piston 22 includes an axial gas exhaust hole 22*a* as well as a wire spring support hole 22*b* extending perpendicular to the gas exhaust hole 22*a* as shown in FIG. 3A.

Figure 4A:
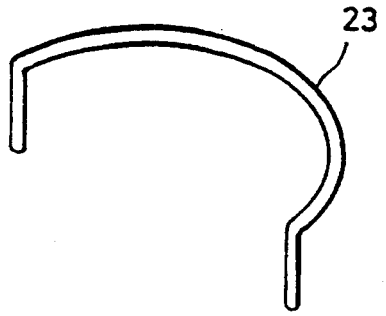
FIGS. 4A and 4B are enlarged perspective views of different embodiments of a steel wire spring used in the lubricating device of FIG. 2A, respectively.
Figure 4B:
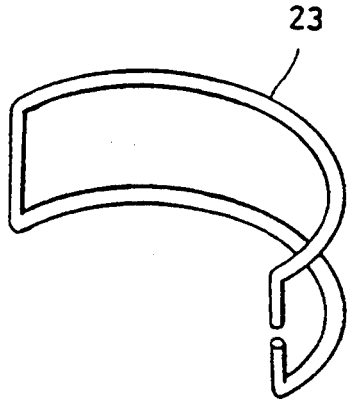

In accordance with the present invention, the wire spring 23 biasing the oil piston 22 upwards may comprise two springs each of which has a C-shaped body and fixtures integrally provided at the opposed ends of the body as shown in FIG. 4A or comprise a solid spring into which two spring bodies are integrated as shown in FIG. 4B. The wire spring 23 biases the oil piston 22 upwards at the outside of the oil pumping chamber 21, thus to improve the designing conditions of the compressor and to achieve a desired smooth oil supply by removing the conventional compression coil spring 8, causing the flow resistance, from the oil pumping chamber 21.

Figure 5A:
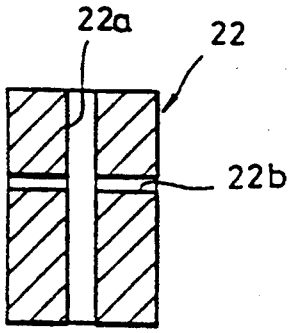
FIGS. 5A to 5C are enlarged sectional views of oil pistons according to the present invention, showing different embodiments of a gas exhaust hole formed in the oil piston.
Figure 5B:
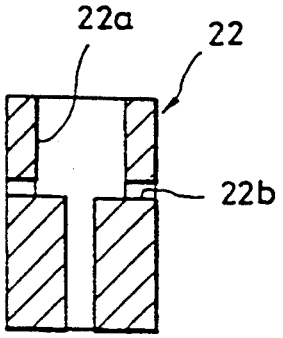
Figure 5C:
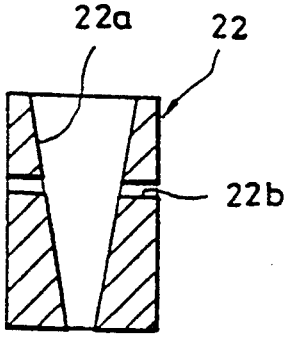

The gas exhaust hole 22*a* of the oil piston 22 allows the gas bubbles generated in the compressed oil to be exhausted to the outside of the chamber 21 and also provides an oil conduit for the piston 22. In accordance with the present invention, the gas exhaust hole 22*a* may have a straight hole shape, a stepped hole shape and a linearly tapered hole shape as shown in FIGS. 5A to 5C, respectively. Here, it is preferred to arrange the oil piston 22 such that the smaller diameter end of the gas exhaust hole 22*a* is downwardly directed in order to face the lower section of the pumping chamber 21.

Figure 3B:
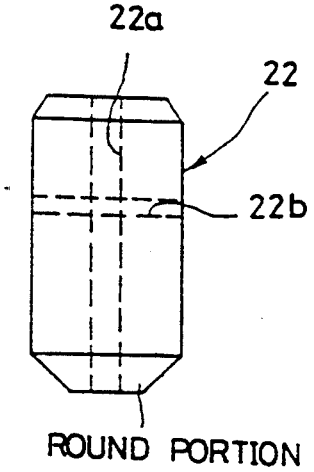
FIGS. 3B and 3C are enlarged views of other embodiments of the oil piston of the lubricating device according to the present invention, respectively.

As shown in FIG. 3B, the lower end of the oil piston 22 facing the lower section of the chamber 21 preferably has a round portion or a conical portion, thus to reduce its oil resistance, the vibration and the noise generated during the oil compression in the pumping chamber 21. In the same manner, the upper end of the oil piston 22 contacting with the lower end of the vane 7 preferably has a round portion or a conical portion, thus to reduce the flow resistance.

Figure 3C:
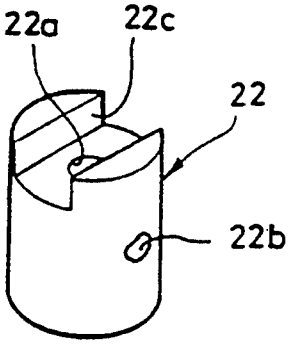

The oil piston 22 also includes a recess 22*c* on its upper center surface as shown in FIG. 3C. This recess 22*c* is adapted for causing a smooth flow of fluids, such as the lubrication oil and the refrigerant. In order to prevent the vane 7 from blocking the gas exhaust hole 22*a* of the oil piston 22, the vane 7 is provided with a recess 7*a* at its lower end surface.

Figure 6A:
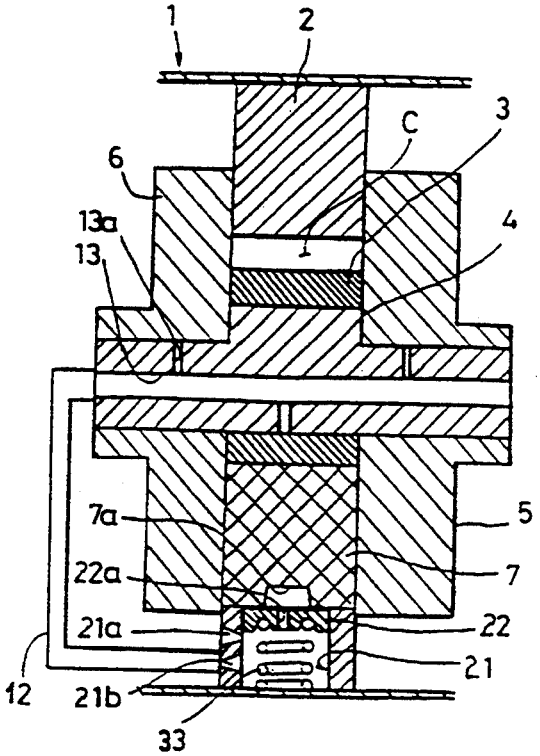
FIGS. 6A and 6B are a longitudinal sectional view and a cross sectional view of a lubricating device in accordance with another embodiment of the present invention, respectively.
Figure 6B:
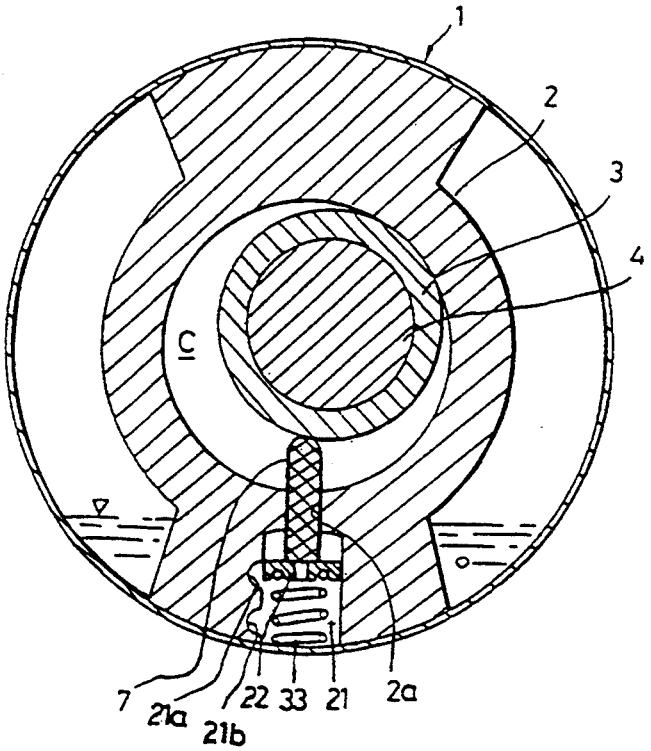
Figure 7A:
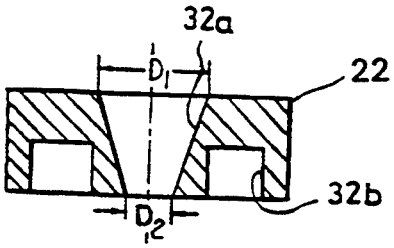
FIGS. 7A and 7B are a sectional view and a plan view of an oil piston used in the lubricating device of FIG. 6A, respectively.
Figure 7B:
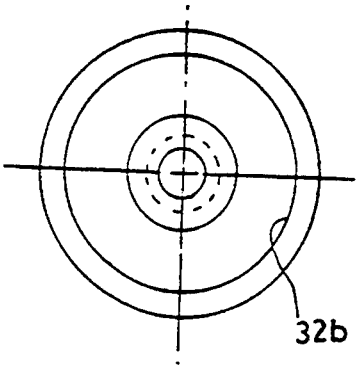
Figure 8A:
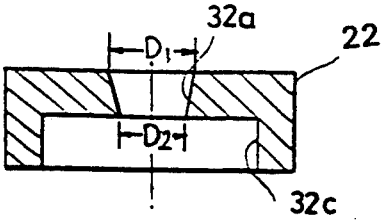
FIGS. 8A and 8B are views corresponding to FIGS. 7A and 7B, but showing another embodiment of the present invention.
Figure 8B:
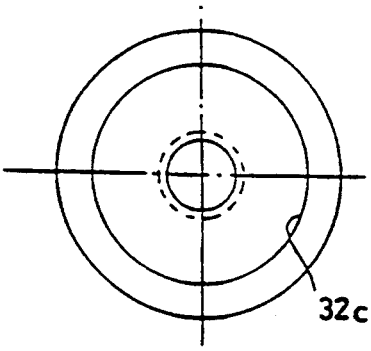

Turning to FIGS. 6A and 6B, there is shown a lubricating device for the horizontal type rotary compressor in accordance with a second embodiment of the present invention. In this second embodiment, some of the elements are common with those of the conventional lubricating device of FIG. 1A and, in this regard, those elements common to both this device and the conventional device will thus carry the same reference numerals.

As shown in these drawings, FIGS. 6A and 6B, this lubricating device has an eccentric rotating shaft 4 which is axially positioned in a shell 1 constituting a horizontal compressor casing. The eccentric shaft 4 is received in a cylindrical cavity of a compression cylinder 2, defining a compression chamber C therein, and provided with a roller 3 thereabout. An outer surface of this roller 3 comes into contact with an inner surface of the compression cylinder 2. The cylinder 2 is coupled at its both sides to a main bearing 5 and a sub bearing 6, respectively, which support the shaft 4 at opposed sides of the cylinder 2 and define the compression chamber C in cooperation with the inner surface of the cylinder 2. The lubricating device also comprises a vane slot 2*a* which is provided in a lower section of the cylinder 2 such that it communicates with the compression chamber C of the cylinder 2. This vane slot 2*a* movably receives a vane 7 of which the distal end comes into close contact with the outer surface of the roller 3, so that when the roller 3 is eccentrically rotated in the cavity of the cylinder 2 by the rotation of the shaft 4, the vane 7 elastically advances and retracts. An oil pumping chamber 21 is provided in the cylinder 2 under the vane 7. This oil pumping chamber 21 is provided with an oil inlet port 21*a* and an oil outlet port 21*b* on a side wall thereof. The oil pumping chamber 21 also includes a hydraulic diode 22*a* for causing the lubrication oil "o"

to partially flow in and flow out from the chamber 21. An oil piston 22 is slidably received in this pumping chamber 21 for sucking and delivering of the lubrication oil. This piston 22 is biased by a compression coil spring 33 which is placed under the piston 22 in the pumping chamber 21. The piston 22 vertically reciprocates in accordance with vertical reciprocation of the vane 7.

The oil outlet port 21*b* of the chamber 21 communicates with the oil conduit 13 of the shaft 4 by an oil feed pipe 12, thus to introduce the lubrication oil under pressure from the pumping chamber 21 to the oil conduit 13.

Figure 1A:
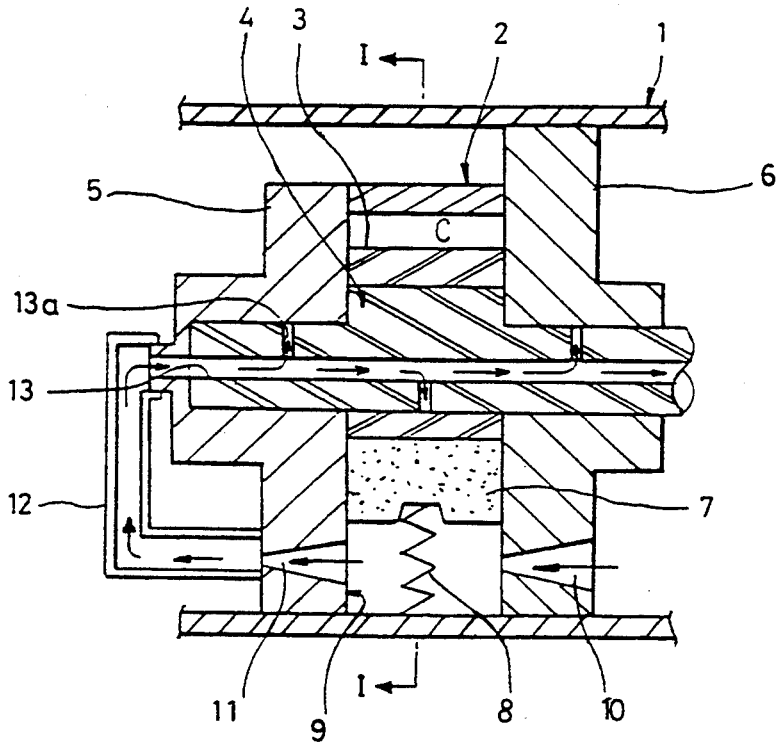
FIG. 1A CONVENTIONAL ART
FIG. 1A is a partial sectional view showing a construction of a conventional lubricating device for a horizontal type rotary compressor.
Figure 1B:
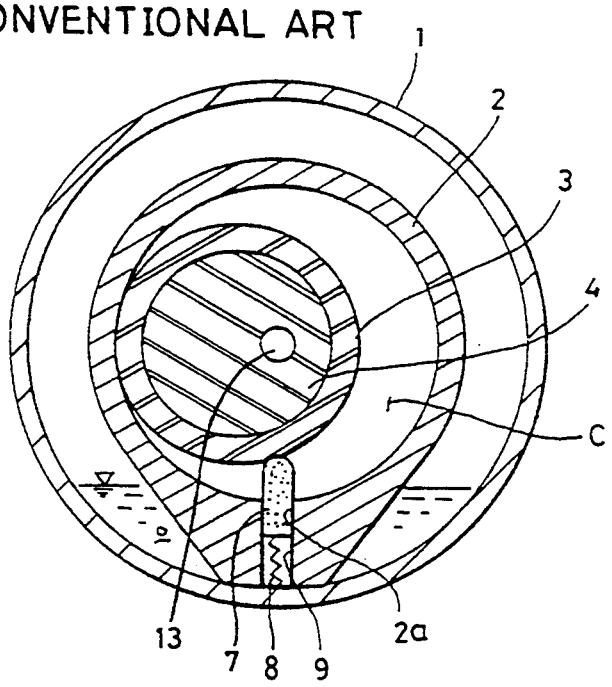
FIG. 1B CONVENTIONAL ART
FIG. 1B is a sectional view of the conventional lubricating device taken along the section line I—I of FIG. 1A.

In accordance with this second embodiment, the oil pumping chamber 21 is not defined by the main and sub bearing 5 and 6 but formed in the compression cylinder 2 differently from the conventional lubricating device of FIG. 1A. In order to provide the oil pumping chamber 21 in the compression cylinder 2, a cylindrical cavity is formed under the vane 7 in the compression cylinder 2. This cavity is in turn provided with the oil inlet and outlet ports 21*a* and 21*b* on upper and lower sections of the side wall thereof, respectively, such that the ports 21*a* and 21*b* are spaced out at a predetermined interval. Owing to the provision of the oil pumping chamber 21 defined in the compression cylinder 2 without the main and sub bearings 5 and 6, this lubricating device reduces the sizes and weights of the bearings 5 and 6, thus to achieve the recent trend of miniaturization and lightness of the compressor as well as easy fabrication of the compressor.

In this second embodiment, the oil inlet port 21*a* of the pumping chamber 21 is placed under the normal level of the lubrication oil "o" in the shell 1 while the oil outlet port 21*b* is formed under the inlet port 21*a* at a position spaced apart from the inlet port 21*a* by the predetermined distance. It is noted that the distance between the spaced ports 21*a* and 21*b* has a close concern with the pumping amount of the lubrication oil to be supplied to the oil conduit 13 of the shaft 4 by the pumping chamber 21.

As shown in FIGS. 7A and 7B, 8A and 8B, the hydraulic diode 32*a* is formed in the oil piston 22 and preferably has such tapered structure that its upper diameter $D_1$ is equal to or larger than its lower diameter $D_2$. The oil piston 22 is also provided with cylindrical or annular support recess 32*b* or 32*c* on its lower surface for supporting the upper end of the compression coil spring 33.

Figure 9:
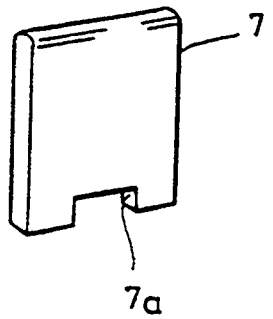
FIG. 9 is a perspective view of a vane used in the lubricating device of FIG. 6A.
Figure 10:
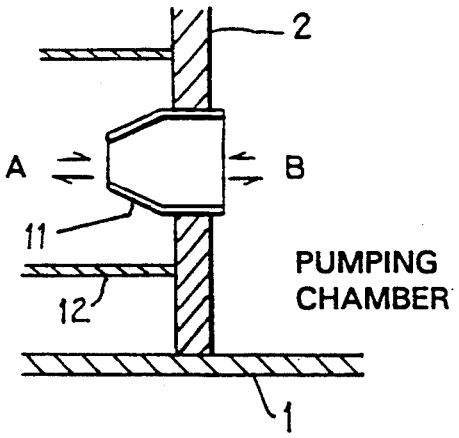
FIG. 10 is a sectional view of an oil outlet diode provided in an oil outlet port of the lubricating device of FIG. 6A.

In order to prevent the vane 7 from blocking the hydraulic diode 22*a* of the oil piston 32 and to allow the fluids such as the lubrication oil and the refrigerant to smoothly flow toward the diode 32*a*, the vane 7 is provided with a recess 7*a* on its lower end surface contacting with the upper end surface of the piston 22 as shown in FIG. 9. In addition, the oil outlet port 21*b* of the oil pumping chamber 21 is provided with an oil outlet hydraulic diode 11 as shown in FIG. 10. This diode 11 has such different diameters that the outside diameter is smaller than the inside diameter, thus to cause a smooth flow out of the lubrication oil therethrough but limit flow in of the oil therethrough.

In oil pumping operation of the lubricating device of the second embodiment, the compression coil spring 33 provided under the oil piston 22 biases the piston 22 upwards toward the vane 7, so that the piston 22 vertically reciprocates in the pumping chamber 21 in accordance with the vertical reciprocation of the vane 7 caused by the eccentric rotation of the shaft 4 and the biasing force of the spring 33, thus to suck and deliver the lubrication oil of the shell 1. When the oil piston 22 moves downwards in the pumping chamber 21 and passes by the oil inlet port 21*a*, it compresses the oil in the chamber 21. At this time, the lubrication oil intending to reversely flow through the diode 21*a* is limited in its amount to be very small since the diode 32*a* is reversely positioned as shown in FIGS. 7 and 8, so that the lubrication oil under pressure flows out to the oil feed pipe 12 through the oil outlet port 21*b*.

On the other hand, when the vane 7 moves upwards and, as a result, the oil piston 22 moves upwards by the biasing force of the compression coil spring 33, the lubrication oil is smoothly introduced from the shell 1 into the pumping chamber 21 through the diode 32*a* because of the shape of the diode 21*a*. Thus, the negative pressure is not generated in the pumping chamber 21.

As described above, the lubrication oil is repeatedly introduced from the shell 1 into the chamber 21, compressed by the piston 22 and fed to the oil conduit 13 of the shaft 4 through the oil feed pipe 12.

Here, the amount of lubrication oil to be fed to the oil conduit 13 of the shaft 4 is determined by the amount of lubrication oil delivered to the oil feed pipe 12 and the amount of lubrication oil introduced into the chamber 21 during one stroke of the vane 7. Since there is no oil pumping operation in the oil pumping chamber 21 when the oil piston 22 is placed over the oil inlet port 21*a*, the oil pumping section of the pumping chamber 21 is defined between a position just below the oil inlet port 21*a* and a bottom dead point of the vane 7 in the chamber 21.

Figure 11A:
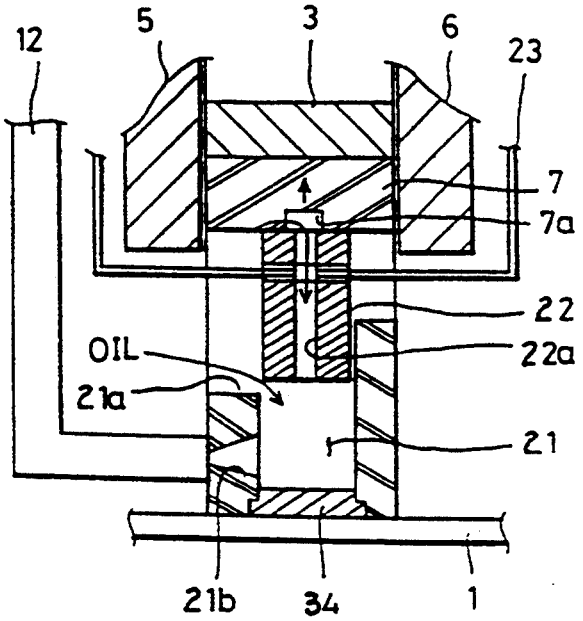
Figure 11B:
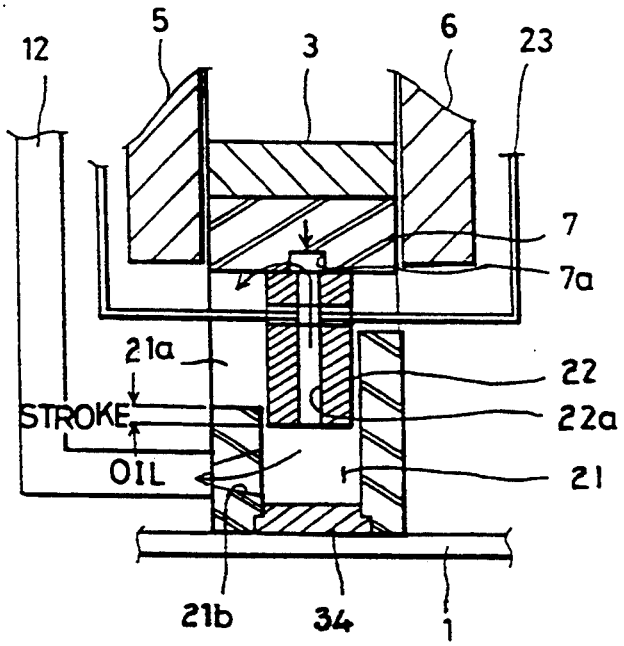

Turning to FIGS. 11A and 11B, there is shown an oil pumping operation of the lubricating device according to the primary embodiment of the present invention. In order to prevent oil leakage from the oil pumping chamber 21 through a gap between the lower end of the chamber 21 and the shell 1 during the oil compressing operation, a plug 34 is tightly mounted on the lower end of the chamber 21 such that there is formed no gap between the lower end of the chamber 21 and the shell 1.

In the oil pumping operation of the device according to the primary embodiment, the oil piston 22 is biased upwards by the steel wire spring 23 such that it comes into close contact with lower end of the vane 7 and vertically reciprocates together with this vane 7. When the oil piston 22 moves upwards as shown in FIG. 10, the lubrication oil including gases is introduced from the inside of the shell 1 into the oil pumping chamber 21 through the gas exhaust hole 22*a* of the oil piston 22 before the piston 22 passes by the oil inlet port 21*a*. At this time, the lubrication oil previously fed to the oil feed pipe 12 intends to partially reversely flows in the pumping chamber 21. However, the lubrication oil reversely flowing from the feed pipe 12 to the pumping chamber 21 is limited in its amount to be very small since the oil outlet diode 11 is reversely positioned as shown in FIG. 10.

The continued upward movement of the oil piston 22 in the pumping chamber 21 opens the oil inlet port 21*a* and, as a result, the lubrication oil is introduced into the pumping chamber 21 through the oil inlet port 21*a*. When the piston 22 starts its downward movement from its upper dead point in order to compress the oil in the chamber 21, the lubrication oil under pressure is fed to the oil feed pipe 12 through the oil outlet port 21*b* in order to be supplied to the oil conduit 13 of the shaft 4 and, at the same time, the gases in the state of bubbles included in the lubrication oil are exhausted to the outside through the gas exhaust pipe 22*a* of the piston 22.

In this oil compression and oil supply operation, most of the lubrication oil under pressure are fed to the oil feed pipe 12 showing a smaller flow resistance due to the shape of the oil outlet diode 11 of the oil outlet port 21*b* while only small amount of lubrication oil flows out from the chamber 21 through the gas exhaust hole 32*a* showing a larger flow resistance. A desired amount of lubrication oil under pressure is thus supplied to the oil conduit 13 of the shaft 4 through the oil feed pipe 12 and, thereafter, supplied to the friction parts of the compressor through the lubricating slots 13*a*.

As well known to those skilled in the art, the lubrication oil is charged in the shell 1 together with the gases. In accordance with the present invention, the lubrication oil is introduced into the oil pumping chamber 21 together with the gases. The lubrication oil in the chamber 21 is, thereafter, supplied to the oil conduit 13 of the shaft 4 by the pumping operation of the pumping chamber 21, while the gases form bubbles in the oil in accordance with both the vertical reciprocation of the vane 7 and the piston 22 and the change of the inner pressure of the pumping chamber 21, caused by the vertical reciprocation, thus to become a mixture.

At this time, the gas exhaust hole 32*a* of the piston 22 has such tapered structure that its upper diameter facing to the vane 7 is larger than its lower diameter facing the pumping chamber 21, so that the lubrication oil scarcely flows out from the pumping chamber 21 through the gas exhaust hole 32*a* while it easily flows in the chamber 21 through the hole 32*a*. In addition, the lower end of the oil piston 22 has the round portion or the conical portion in order to reduce the oil resistance. Hence, when the oil piston 22 moves downwards in the chamber 21 after passing by the oil inlet port 1*a* in order to compress the oil in the chamber 21, a desired smooth contact of the lower end of the piston 22 with the oil is achieved, thus to reduce the vibration and the noise generated during the oil compression in the pumping chamber 21.

As described above, a lubricating device for a horizontal type rotary compressor in accordance with the present invention includes an oil pumping chamber which is not defined by main and sub bearings but formed in a compression cylinder of the compressor under a spring-biased vane, thus to remarkably reduce the size of the main and sub bearings and to reduce the cost of the compressor. The lubricating device also removes the conventional biasing member, such as a compression coil spring, from the inside of the pumping chamber and can easily increase the eccentricity of the eccentric rotating shaft, thus to be desirably adapted to a compressor of larger capacity. The removing of the biasing member from the inside of the pumping chamber results in reduction of the flow resistance in the pumping chamber. In addition, the lubricating device includes a gas exhaust hole formed in an oil piston received in the pumping chamber and exhausts the gases included in the lubrication oil to the outside, thus to improve the quality of the lubrication oil supplied to the friction parts of the compressor and, as a result, to improve the reliability of the compressor.

Furthermore, the lubricating device of this invention easily controls the amount of lubrication oil as well as the inner pressure of the pumping chamber by changing the diameter of the oil piston differently from the conventional lubricating device in which the amount of lubrication oil is controlled by changing the width of the vane or changing the designing conditions of the hydraulic diodes.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A lubricating device for a horizontal type rotary compressor, said compressor having a compression cylinder fixed in a compressor shell and having a cylindrical cavity therein, an eccentric rotating shaft axially rotatably received in said cavity of the cylinder, main and sub bearings coupled to opposed sides of said cylinder for rotatably supporting said eccentric rotating shaft, and a roller mounted about said shaft, comprising:

a vane movably received in a vane slot provided in a lower section of said compression cylinder, a top of said vane contacting with an outer surface of said roller such that it vertically reciprocates in accordance with rotation of said shaft;

a cylindrical oil pumping chamber provided in said compression cylinder under said vane, said chamber having an oil inlet port and an oil outlet port for sucking and delivering lubrication oil, respectively, said ports having individual hydraulic diodes;

an oil piston received in said pumping chamber such that it elastically vertically reciprocates in said pumping chamber in accordance with vertical reciprocation of said vane;

a steel wire spring connected at one end thereof to said oil piston and at the other end thereof to one of said compression cylinder, said main bearing and said sub bearing for biasing said oil piston upwards at the outside of said pumping chamber; and an oil feed pipe connected between said oil outlet port of the pumping chamber and an oil conduit of said eccentric rotating shaft.

2. The lubricating device according to claim 1, wherein said oil piston includes:

a gas exhaust hole axially provided in said piston for exhausting gases included in said lubrication oil to the outside of said chamber; and a wire spring support hole extending perpendicular to said gas exhaust hole.

3. The lubricating device according to claim 1, wherein said oil piston includes a round or conical portion on a lower end thereof for reduction of fluid resistance.

4. The lubricating device according to claim 2, wherein said gas exhaust hole is one of a straight hole, a stepped hole and a tapered hole.

5. The lubricating device according to claim 2, wherein said oil piston includes a recess on a upper center surface thereof for causing a smooth flow of fluids on an upper surface of said oil piston.

6. The lubricating device according to claim 1, wherein the oil inlet port is provided on a side wall of said cylindrical oil pumping chamber.

7. The lubricating device according to claim 1, wherein the oil outlet port is provided on a side wall of said cylindrical oil pumping chamber.

8. A lubricating device for a horizontal type rotary compressor comprising:

a vane movably received in a vane slot provided in a lower section of a compression cylinder of said compressor, a top of said vane contacting with an outer surface of a roller of an eccentric rotating shaft of said compressor such that it vertically reciprocates in accordance with rotation of said shaft;

a cylindrical oil pumping chamber provided in said compression cylinder under said vane, said chamber having an oil inlet port and an oil outlet port for sucking and delivering lubrication oil, respectively, said ports being spaced out at a predetermined interval;

a hydraulic diode provided in said pumping chamber for causing lubrication oil to flow in and flow out from said pumping chamber;

an oil piston received in said pumping chamber such that it elastically vertically reciprocates in said pumping chamber in accordance with vertical reciprocation of said vane;

a compression coil spring placed under said oil piston for biasing said piston toward said vane; and an oil feed pipe connected between said oil outlet port of the pumping chamber and an oil conduit of said eccentric rotating shaft.

9. The lubricating device according to claim 8, wherein said hydraulic diode is axially formed in said oil piston and has such shape that an upper diameter thereof is not smaller than a lower diameter thereof, and said oil piston includes a circular support recess on a lower surface thereof for supporting an upper end of said compression coil spring.

10. The lubricating device according to claim 8, wherein said vane is provided with a recess on a lower end surface thereof contacting with said oil piston, for causing a smooth flow of said lubrication oil.

11. The lubricating device according to claim 6, wherein the oil inlet port is provided on a side wall of said cylindrical oil pumping chamber.

12. The lubricating device according to claim 6, wherein the oil outlet port is provided on a side wall of said cylindrical oil pumping chamber.

* * * * *